United States Patent [19]

Towns

[11] Patent Number: 4,588,170

[45] Date of Patent: May 13, 1986

[54] SIDE MOUNTED LANCE FOR LADLES

[75] Inventor: Jeffrey A. Towns, New Waterford, Ohio

[73] Assignee: Insul Company, Inc., East Palestine, Ohio

[21] Appl. No.: 773,237

[22] Filed: Sep. 6, 1985

[51] Int. Cl.[4] ..... C21C 5/32

[52] U.S. Cl. ..... 266/225; 75/53; 266/217; 266/218

[58] Field of Search ..... 266/224, 225, 217, 218; 75/53, 58

[56] References Cited

U.S. PATENT DOCUMENTS

| | | | |
|---|---|---|---|
| 3,230,075 | 1/1966 | Nakamura | 75/53 |
| 3,310,238 | 3/1967 | Bryant | 266/225 |
| 3,945,820 | 3/1976 | Brotzmann | 75/59 |
| 3,961,779 | 6/1976 | Tiberg | 266/225 |
| 4,179,103 | 12/1979 | Bentz | 266/225 |
| 4,211,553 | 7/1980 | Honkaniemi | 75/53 |
| 4,389,245 | 6/1983 | Blair | 75/58 |
| 4,401,466 | 8/1983 | Wells | 266/218 |
| 4,433,832 | 2/1984 | Butts | 266/225 |

*Primary Examiner*—Peter D. Rosenberg
*Attorney, Agent, or Firm*—Harpman & Harpman

[57] ABSTRACT

A nitrogen bubbling lance for a hot metal ladle having a refractory lining has a refractory body shaped to facilitate the positioning of the lance in a vertical groove in the side wall of the ladle so as to become part of the refractory lining. A tubular member is positioned longitudinally within the lance and communicates with one or more openings in the lower side wall thereof communicating with the interior of the ladle and the molten hot metal therein. The openings are plugged with porous or nonporous material. Nitrogen introduced through the tubular member is delivered through the openings and/or the porous plugs to bubble upwardly through the molten hot metal in a stirring action.

7 Claims, 4 Drawing Figures

SIDE MOUNTED LANCE FOR LADLES

DESCRIPTION OF THE INVENTION

1. Technical Field

This invention relates to apparatus for bubbling nitrogen through molten metal in a ladle.

2. Background Art

Apparatus for introducing gases into molten metal for various purposes are disclosed in U.S Pat. Nos. 3,230,075 and 3,945,820 which disclose immersion lances for refining metal melts in hearth-type vessels. Apparatus for introducing gas into a ladle is disclosed in U.S. Pat. No. 3,961,779 and a lance useful for the same practice is disclosed in U.S. Pat. No. 4,179,103. A lance for refining a melt by means of a pulverous solid material and a carrier gas is disclosed in U.S. Pat. No. 4,211,553 and a lance for a similar purpose positioned in a ladle in spaced relation to the side wall thereof is disclosed in U.S. Pat. No. 4,389,245 in which one form of the lance is combined with a vertically movable stopper.

In the prior U.S. Pat. No. 3,230,075 and 3,945,820, the lances are introduced through an angularly arranged opening in the side wall of a hearth vessel and a similar arrangement for introducing a lance into a ladle is disclosed in U.S. Pat. No. 3,961,779. The other prior art inventions referred to hereinbefore are arranged to be positioned directly into the open top of the ladle and no prior art is known wherein a modified lance construction enables it to be incorporated in the refractory side wall lining of a ladle so as to be securely positioned in a desired location so that the bubbling nitrogen emerging therefrom will always create a desired stirring action in the metal in the ladle as essential in deoxidizing and desulphurizing or otherwise treating the metal, as the case may be.

SUMMARY OF THE INVENTION

The present invention provides a nitrogen bubbling lance having an elongated refractory body member which is cross sectionally square and/or rectangular and particularly suited for positioning in a vertical groove in the refractory lining of a ladle in which molten metal is transported. A tubular member extends longitudinally of the lance and communicates with one or more openings therein which are arranged in oppositely disposed relation to the side wall of the ladle and the openings may be plugged with solid or porous plugs. The tubular member extends outwardly of the upper end of the lance for establishing communication with a source of nitrogen which when introduced into the lance will emerge in controlled jet-like streams from the opening or openings therein to create a highly desirable stirring action in the molten metal being transported by the ladle.

DESCRIPTION OF THE PREFERRED EMBODIMENT

Figure 1:
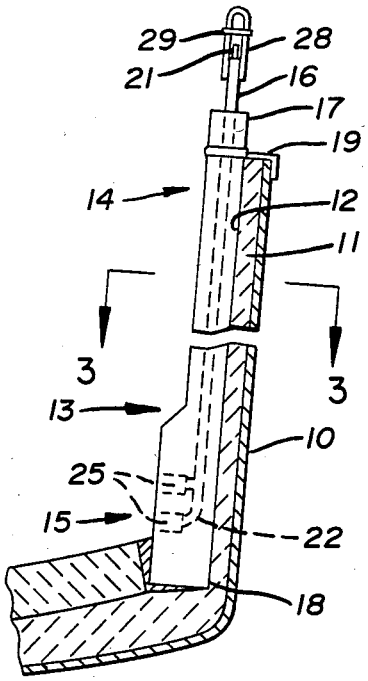
FIG. 1 is a side elevation of a portion of a ladle showing the side mounted lance positioned therein with parts broken away.
Figure 3:
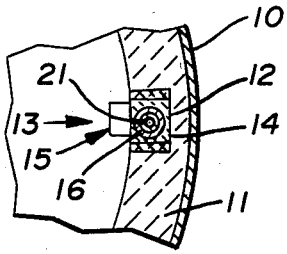
FIG. 3 is a horizontal section on line 3—3 of FIG. 1

By referring to the drawings and FIGS. 1 and 3 in particular, it will be seen that a portion of a ladle 10 has been disclosed which is a vessel of any suitable or conventional construction as well known in the steel making industry. The ladle 10 has a protective refractory lining 11 such as refractory brick or the like. The side wall of the ladle 10 has a substantially vertical groove 12 formed therein in which the side mounted lance is positioned. The lance comprises an elongated refractory body member generally indicated at 13 and having an upper portion 14 which is cross sectionally square and a lower portion 15 which is cross sectionally rectangular. A tubular member 16 formed of pipe is positioned longitudinally in the elongated refractory body member of the lance 13 and extends outwardly of the upper end 17 thereof and terminates inwardly of the lower end 18 thereof.

By referring to FIG. 3 of the drawings, it will be seen that one surface of the lance 13 is positioned flush against the back of the groove 12 in the refractory lining 11 of the ladle and that rammed refractory material is positioned between the walls of the groove 12 and the oppositely disposed side walls of the lance 13 so as to hold it securely in position.

By referring to FIGS. 1 and 3 of the drawings, it will be seen that the upper portion 14 of the lance 13 is positioned within the groove 12 of the refractory lining 11 in the ladle and that a holding device in the form a clip 19 is attached to the lance 13 and extends outwardly and over the upper edge of the ladle 10.

Figure 2:
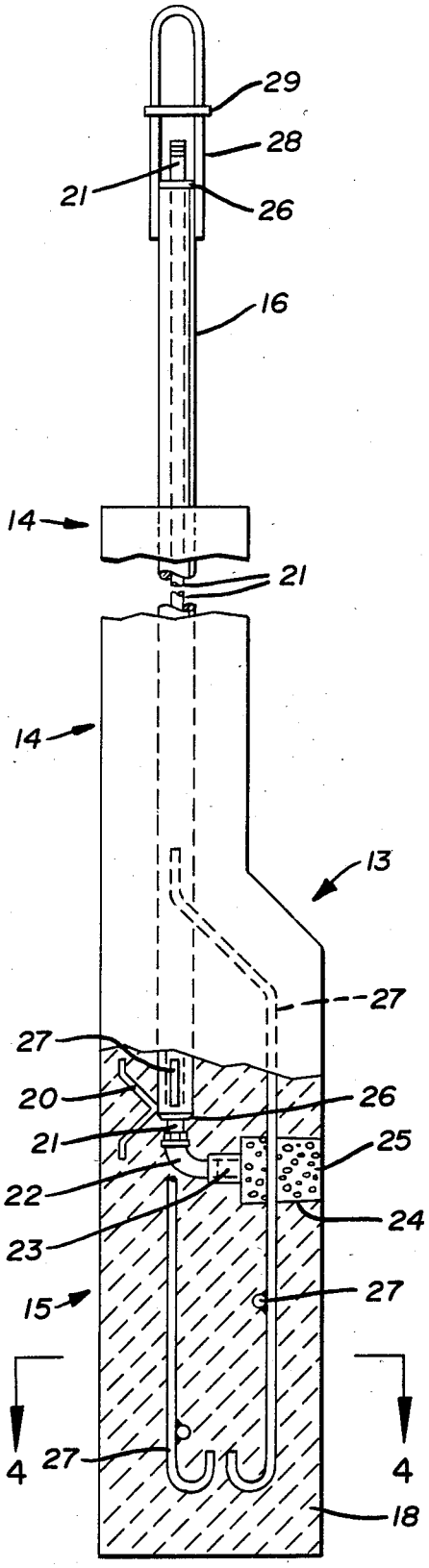
FIG. 2 is an enlarged side elevation of the side mounted lance with parts broken away and parts in cross section.

By referring now to FIG. 2 of the drawings, it will be seen that the tubular member 16 which terminates inwardly of the lower end 18 of the lance carries several circumferentially spaced reinforcing shapes 20 and forms a tubular passageway in which a coaxially positioned smaller tubular member 21 is positioned. A 90° elbow 22 communicates with the lower end of the tubular member 21 and communicates with a fitting 23 which in turn communicates with a cavity 24 in which a porous plug 25 is positioned. The tubular member 21 is spaced with respect to the tubular member 16 by washers 26. Reinforcing bars 27 are welded at their upper ends to the exterior of the tubular member 16 and are shaped so as to extend outwardly thereof and downwardly therebelow to a point inwardly of the lower end 18 of the lower portion 15 of the lance 13.

Figure 4:
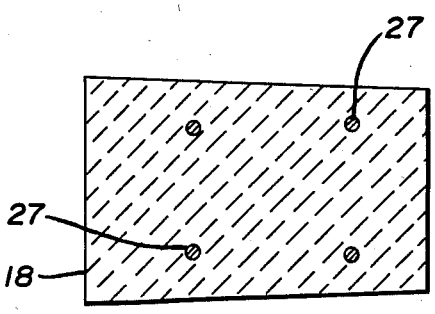
FIG. 4 is a horizontal section on line 4—4 of FIG. 2.

By referring to FIG. 4 of the drawings, a horizontal section of the lower portion 15 of the lance 13 illustrates the spacing of the several reinforcing rods 27.

Still referring to FIG. 2 of the drawings, it will be seen that the upper end of the smaller tubular member 21 extends outwardly of the upper end of the larger tubular member 16 and is spaced with respect thereto by the washer 26. It will also be seen that an inverted U-shaped handle 28 including a cross member 20 is affixed to the upper outer surface of the larger tubular member 16 and extends above the upper end of the smaller tubular member 21 so that the lance can be conveniently attached to a supporting and positioning device and held thereby against the side wall of the ladle in the groove 12 while the same is being secured thereto by the clip 19 and the refractory cement-like binder heretofore referred to.

In FIG. 2 of the drawings, a single cavity 24 is illustrated with a single porous plug 25 therein through which gas, such as nitrogen, introduced into the upper end of the smaller tubular member 21 will flow outwardly into the molten metal in the ladle. Alternately additional plugged or unplugged openings may be provided as illustrated in broken lines in FIG. 1 of the drawings wherein two such cavities are illustrated with porous plugs 25 therein. The openings defined by the cavities 24 and the porous plugs 25 are located in the side of the lance facing the interior of the ladle and the lance 13 is positioned on the transverse center line of the ladle opposite the pouring spout of the ladle as will be understood by those skilled in the art.

It will thus be seen that a novel and highly efficient side mounted lance for a transport ladle for molten metal, such as steel, has been disclosed in which the lance has a novel configuration and is so positioned in the ladle as to occupy a minimum of space therein and at the same time insure the desired direction of the gas introduced therethrough into the molten metal.

Having thus disclosed my invention, what I claim is:

1. Apparatus for bubbling gas into molten metal in a ladle having a protective refractory lining on the bottom and side walls thereon, said apparatus comprising a lance consisting of an elongated refractory body member of a configuration registering with a vertical groove in the refractory lining in the side wall of said ladle, at least one tubular member positioned axially of said elongated body member and extending outwardly of one end thereof and communicating with at least one opening in said elongated body member inwardly of the opposite end thereof, said opening facing the interior of said ladle and means for introducing gas into said tubular member.

2. The apparatus for bubbling gas into molten metal in a ladle set forth in claim 1 and wherein there are two tubular members, one of which is of a larger diameter than the other, said tubular members being positioned coaxially and wherein the smaller tubular member communicates with said opening and the means for introducing gas.

3. The apparatus for bubbling gas into molten metal in a ladle set forth in claim 1 and wherein said elongated refractory body member has upper and lower portions, the upper portion being cross sectionally square and the lower portion being cross sectionally rectangular and wherein the groove in the refractory lining in the side wall of the ladle defines a cross sectionally square cavity of a size substantially the same as the cross sectionally square upper portion of said elongated body member.

4. The apparatus for bubbling gas into molten metal in a ladle set forth in claim 1 and wherein at least one reinforcing bar is affixed to said tubular member and extends within said elongated body member beyond said opening therein in oppositely disposed relation to said tubular member.

5. The combination of a transport ladle for molten metal such as steel and a lance for bubbling gas into said molten metal, said transport ladle having bottom and side walls and a protective refractory lining thereon, said lance consisting of an elongated refractory body member of a configuration registering with a vertical groove in the refractory lining in the side wall of the ladle and with a cavity in the refractory lining on the bottom of said ladle adjacent said groove, at least one tubular member positioned axially of said elongated refractory body member and extending outwardly of one end thereof and communicating with at least one opening in said elongated refractory body member inwardly of the opposite end thereof, said opening facing the interior of said ladle, means for securing said lance in said vertical groove and cavity in the protective refractory lining of said ladle and means for introducing gas into said tubular member.

6. The combination set forth in claim 5 and wherein there are two tubular members, one of which is of a larger diameter than the other, said tubular members being positioned coaxially and wherein the smaller tubular member communicates with said opening and the means for introducing gas.

7. The combination set forth in claim 5 and wherein said elongated refractory body member has upper and lower portions, the upper portion being cross sectionally square and the lower portion being cross sectionally rectangular and wherein the elongated groove in the refractory lining in the side wall of the ladle defines a cross sectionally square cavity of a size substantially the same as the cross sectionally square upper portion of said elongated body member.

* * * * *